US010211007B2

(12) United States Patent
Domzalski et al.

(10) Patent No.: US 10,211,007 B2
(45) Date of Patent: Feb. 19, 2019

(54) ELECTRICAL PUSHBUTTON SWITCH

(71) Applicant: C&K COMPONENTS S.A.S., Dole (FR)

(72) Inventors: Frank Domzalski, Wellesley, MA (US); William Agnatovech, Hudson, MA (US)

(73) Assignee: C&K Components S.A.S., Dole (FR)

( * ) Notice: Subject to any disclaimer, the term of this patent is extended or adjusted under 35 U.S.C. 154(b) by 0 days.

(21) Appl. No.: 15/895,169

(22) Filed: Feb. 13, 2018

(65) Prior Publication Data

US 2018/0233305 A1 Aug. 16, 2018

Related U.S. Application Data

(63) Continuation of application No. 15/342,847, filed on Nov. 3, 2016, now Pat. No. 9,947,492.

(30) Foreign Application Priority Data

Nov. 3, 2015 (EP) ..... 15192708

(51) Int. Cl.

| | |
|---|---|
| ***H01H 13/14*** | (2006.01) |
| ***H01H 13/20*** | (2006.01) |
| ***H01H 3/42*** | (2006.01) |
| ***H01H 9/04*** | (2006.01) |
| ***H01H 13/06*** | (2006.01) |
| ***H01H 13/18*** | (2006.01) |
| ***H01H 13/52*** | (2006.01) |
| ***H01H 13/64*** | (2006.01) |

(52) U.S. Cl.

CPC ..... *H01H 13/14* (2013.01); *H01H 3/42* (2013.01); *H01H 9/041* (2013.01); *H01H 13/063* (2013.01); *H01H 13/183* (2013.01); *H01H 13/20* (2013.01); *H01H 13/52* (2013.01); *H01H 13/64* (2013.01); *H01H 2231/026* (2013.01)

(58) Field of Classification Search

CPC ..... H01H 13/48; H01H 13/52; H01H 13/56; H01H 13/20; H01H 13/36; H01H 13/365; H01H 15/02; H01H 15/06; H01H 1/242

See application file for complete search history.

(56) References Cited

U.S. PATENT DOCUMENTS

| | | | |
|---|---|---|---|
| 2,743,331 | A | 4/1956 | Lauder et al. |
| 3,098,905 | A | 7/1963 | Anderson |
| 3,809,837 | A | 5/1974 | Yoshioka |
| 6,399,908 | B1 | 6/2002 | Mueller et al. |

(Continued)

*Primary Examiner* — Ahmed Saeed
(74) *Attorney, Agent, or Firm* — Fox Rothschild LLP

(57) ABSTRACT

A switch includes a pushbutton comprising an actuating portion, a first fixed contact element and a first movable contact element facing the first fixed contact element for establishing a first switching way. The first movable contact element may include a movable portion of a first elastically deformable conductive blade. The actuating portion may include a first cam which cooperates with a cam follower portion of the first blade to deform or relax the first blade for longitudinally moving the first movable contact element to come into contact, or out of contact, with the portion of the first fixed contact element, depending on the vertical position of the actuation member. A second fixed contact element and second movable contact may be similarly constructed to provide a second switching way.

17 Claims, 8 Drawing Sheets

(56) References Cited

U.S. PATENT DOCUMENTS

| | | | | |
|---|---|---|---|---|
| 6,753,489 | B2 * | 6/2004 | Kiyono | H01H 13/183 200/200 |
| 8,362,375 | B2 | 1/2013 | Wildman | |
| 9,613,765 | B2 | 4/2017 | Koepsell | |
| 2010/0025205 | A1 | 2/2010 | Domzalski | |
| 2011/0147186 | A1 | 6/2011 | Mori et al. | |

* cited by examiner

ELECTRICAL PUSHBUTTON SWITCH

RELATED APPLICATIONS AND CLAIM OF PRIORITY

This patent document is a continuation of, and claims priority to, U.S. patent application Ser. No. 15/342,847, filed Nov. 3, 2016, which claims priority to European Patent Application No. EP15192708.4, filed in the European Patent Office on Nov. 3, 2015. The disclosures of these priority applications are fully incorporated into this document by reference.

BACKGROUND

This document relates to an electrical switch, also known as a switch. The document describes a switch which might be used as a detect switch in the car vehicles field, for example in association with a door latch.

Electrical switches have been designed for selectively establishing at least a first conductive way between two conductive fixed contacts, the switch comprising a housing, and a pushbutton arranged so that, when an external force is applied to the pushbutton, the pushbutton is moved relative to the housing between a pushbutton position in which the conductive way is established; and a pushbutton position in which the conductive way is interrupted. This conductive way, and thus the switch, can be of the normally open (NO) type or of the normally closed (NC) type.

According to a known design, such a switch might be of the "snap switch" type such as illustrated in U.S. Pat. Nos. 2,743,331 or 3,098,905.

In such a design, the switch has a high current carrying capacity or ability, and long life duration. However, the "snapping" or "clicking" noise might be detrimental in some applications, as well as the presence of a hysteresis. A snap switch also has a limited over travel capacity.

According to another known design, the switch might be of the "slide switch" type such as illustrated in US Patent Application Publication Number 2011/0147186 in which a sliding contact arrangement is disclosed in combination with a snapping arrangement.

In such a design, there is no detrimental noise, neither any hysteresis. However, it cannot adequately carry medium or high currents and may have quite short life duration.

U.S. Pat. No. 6,753,489 discloses an electrical switch comprising a housing having a receiving portion, an actuation member comprising an actuating portion extending into the housing and arranged to be moved vertically between a pushbutton upper position and a pushbutton lower position; a pair of associated contact elements comprising a fixed contact element provided in the receiving portion; a movable contact element arranged facing the fixed contact element and that may come into contact with the fixed contact element for establishing a conductive switching way between the movable contact element and the fixed contact element; and an elastically deformable conductive blade in the form of a hairpin supported by the receiving portion. The blade comprises a movable active branch.

In U.S. Pat. No. 6,753,489, the active branch of the hairpin shaped blade is pivotally mounted with respect to the housing—around a horizontal pivotal axis—between a first active position in which a first switching way is established and a second switching way is interrupted, and a second active position in which the first switching way is interrupted and the second switching way is established.

To provoke the pivotal movement of the active branch, the actuating portion is in the form of a cam acting on the other branch of the hairpin shaped blade.

According to such a design, the pivotal movement of the active branch is providing a noisy snapping effect and in which the two switching ways cannot be controlled independently. Also, in case of medium or high currents, the "floating" design of the blade which globally moves as a whole, does not permit electrical connection of the blade to the outside of the switch.

This document describes an electrical switch that improves on the prior art by having a design that results in little or no hysteresis, that is relatively silent, and that can be designed for "make before break" or "break before make." Also, optionally, the design may permit the carrying of medium or high currents.

SUMMARY

In accordance with a first embodiment, an electrical switch includes a housing having a base with a receiving portion. The switch also includes an actuation member in the form of a pushbutton comprising a stem extending out of the housing and an actuating portion extending the housing. The pushbutton is configured so that when an external force is applied to the pushbutton, the pushbutton will move vertically relative to the housing between a pushbutton upper position and a pushbutton lower position. The switch also includes a first pair of associated contact elements comprising a first fixed contact element comprising a first contact face, and a first movable contact element so arranged facing the first fixed contact element so that the first movable contact element may come into contact with the first fixed contact element and establish a first conductive switching way between the first movable contact element and the first fixed contact element. The first movable contact element also includes a first elastically deformable conductive blade, optionally in the form of a hairpin, that is supported by the receiving portion. The first blade includes a fixed branch and an active branch. The actuating portion of the actuation member includes a first cam which cooperates with a first cam follower portion of the active branch of the first blade to deform or relax the active branch of the first blade for longitudinally moving the first movable contact element to come into contact, or out of contact, with the portion of the first fixed contact element, depending on the vertical position of the actuation member.

Optionally, the switch also may include a second pair of associated contact elements that include a second fixed contact element comprising a second fixed contact face and a second movable contact element arranged facing the second fixed contact element so that the second movable contact element may come into contact with the second fixed contact element and thus establish a second conductive switching way between the second movable contact element and the second fixed contact element. The second movable contact element may also include a second elastically deformable conductive blade supported by the receiving portion. The second blade also may be in the form of a hairpin, and it may include a fixed branch and an active branch. The actuating portion of the actuation member also may include a second cam which cooperates with a second cam follower portion of the active branch of the second blade to deform or relax the active branch of the second blade for longitudinally moving the second movable contact element to come into contact, or out of contact, with the second fixed contact element, depending on the vertical position of the actuation member.

The cam follower portions of the first and second blades may be arranged longitudinally to face each other. The actuating portion of the actuation member may be arranged longitudinally between the first and second movable contact elements.

When the actuating portion is in an upper active position, one of the two conductive switching ways is established and the other conductive switching way is interrupted. When the actuating portion is in a lower active position, that conductive switching way is interrupted and the other conductive switching way is established.

Optionally, the cam follower portions may be made of a bent portion of the first or second active branch with a convexity oriented towards a transversal and vertical actuating face of the actuating portion. The corresponding cam may be provided on the actuating face. The corresponding movable portion may be a free end portion of the active branch.

One of the blades may be optionally in the form of a hairpin, and may include a vertically upwardly extending fixed branch, and an active branch extending vertically downwardly from the upper end of the fixed branch. The active branch may include the corresponding cam follower portion and a movable portion.

The other blade may be optionally in the form of a hairpin, and it may include a vertically downwardly extending fixed branch, and an active branch extending vertically upwardly from the lower end of the fixed branch. The active branch may include the corresponding cam follower portion and a movable portion.

Each blade's movable portion may be a portion of its corresponding active branch arranged at a free end of the active branch and facing the corresponding fixed contact element.

When either cam co-operates with an associated cam follower portion, the associated movable portion of the associated conductive blade is maintained in contact under pressure with the corresponding facing fixed contact element.

The electrical switch may provide symmetry of conception with respect to a median vertical and longitudinal plane of symmetry or so that the components on each side of the plane of symmetry substantially match.

Either movable portion of either contact element, as well as either fixed contact element, may be provided with a contact pill.

BRIEF DESCRIPTION OF THE FIGURES

Other characteristics and advantages of the invention will become apparent from reading the following detailed description, for an understanding of which reference should be made to the appended drawings in which.

DETAILED DESCRIPTION

In the description that follows, identical, similar or analogous components are designated by the same reference numbers. All patent documents referred to in this document are fully incorporated herein by reference. In this document, the singular forms "a," "an," and "the" include plural references unless the context clearly dictates otherwise. In this document, the term "comprising" means "including, but not limited to." Unless defined otherwise, all technical and scientific terms used herein have the same meanings as commonly understood by one of ordinary skill in the art.

As a non-limiting example, to assist in understanding the description and the claims, the terms vertical, horizontal, bottom, top, up, down, transversal, longitudinal, and so on will be adopted with reference to the L, V, T trihedron indicated in the figures, and without any reference to gravity.

Figure 3:
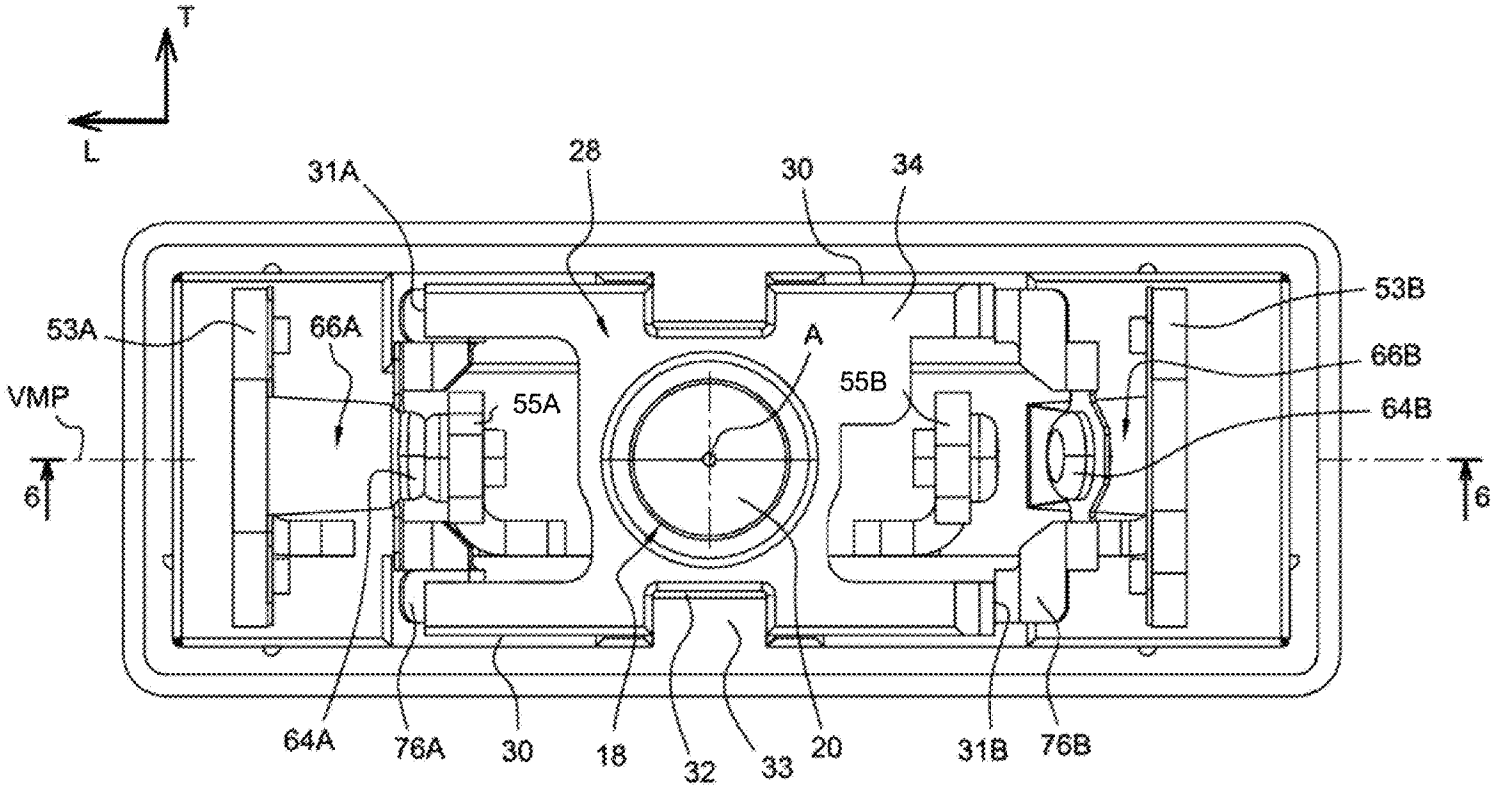
FIG. 3 is a top view of the lower part of the housing of the switch with all the inside components.

In the illustrated embodiments, the design of the whole switch is globally symmetrical with respect to the vertical median plane VMP of FIG. 3, such that components on either side of the plane are substantially symmetric.

Figure 1:
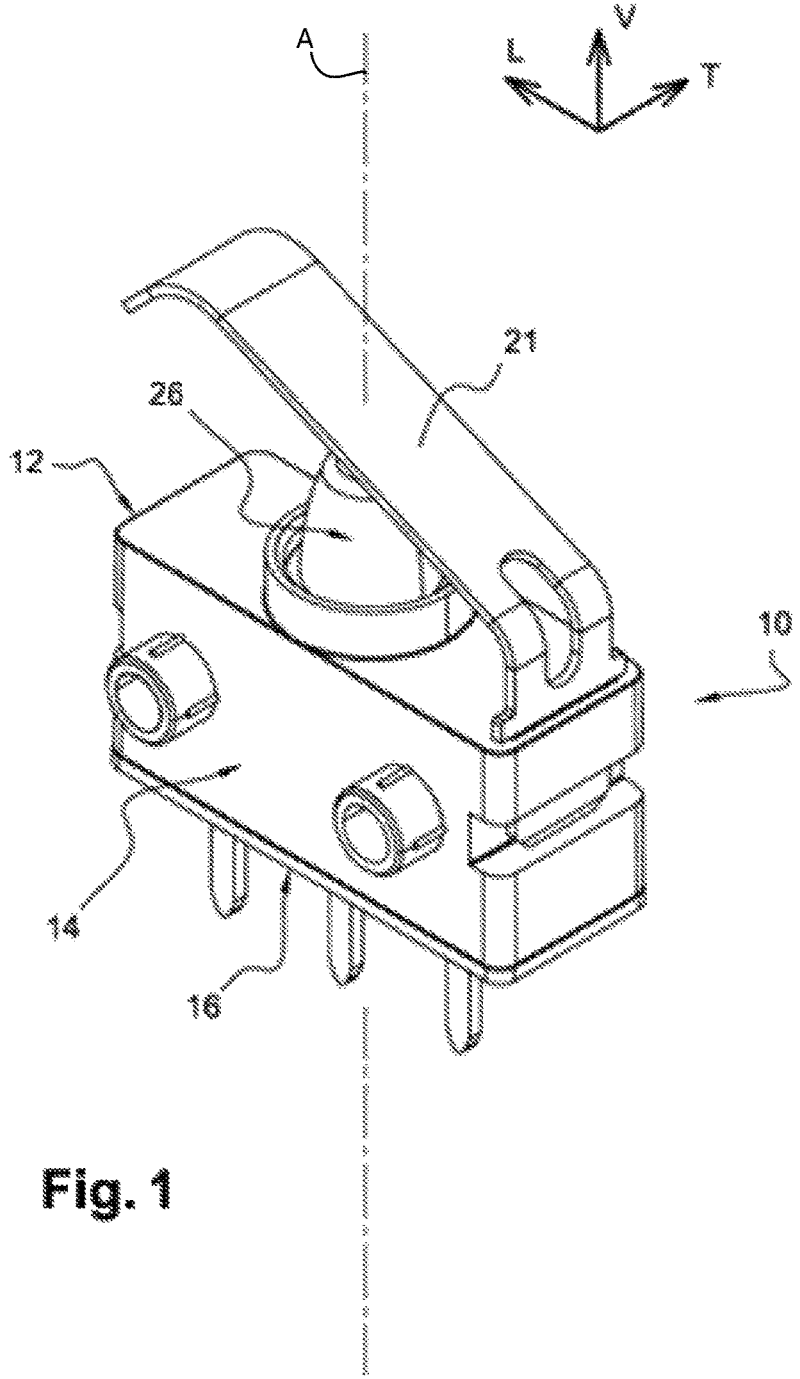
FIG. 1 is a top perspective view which illustrates a first embodiment of a switch providing for two distinct conductive switching ways.
Figure 2:
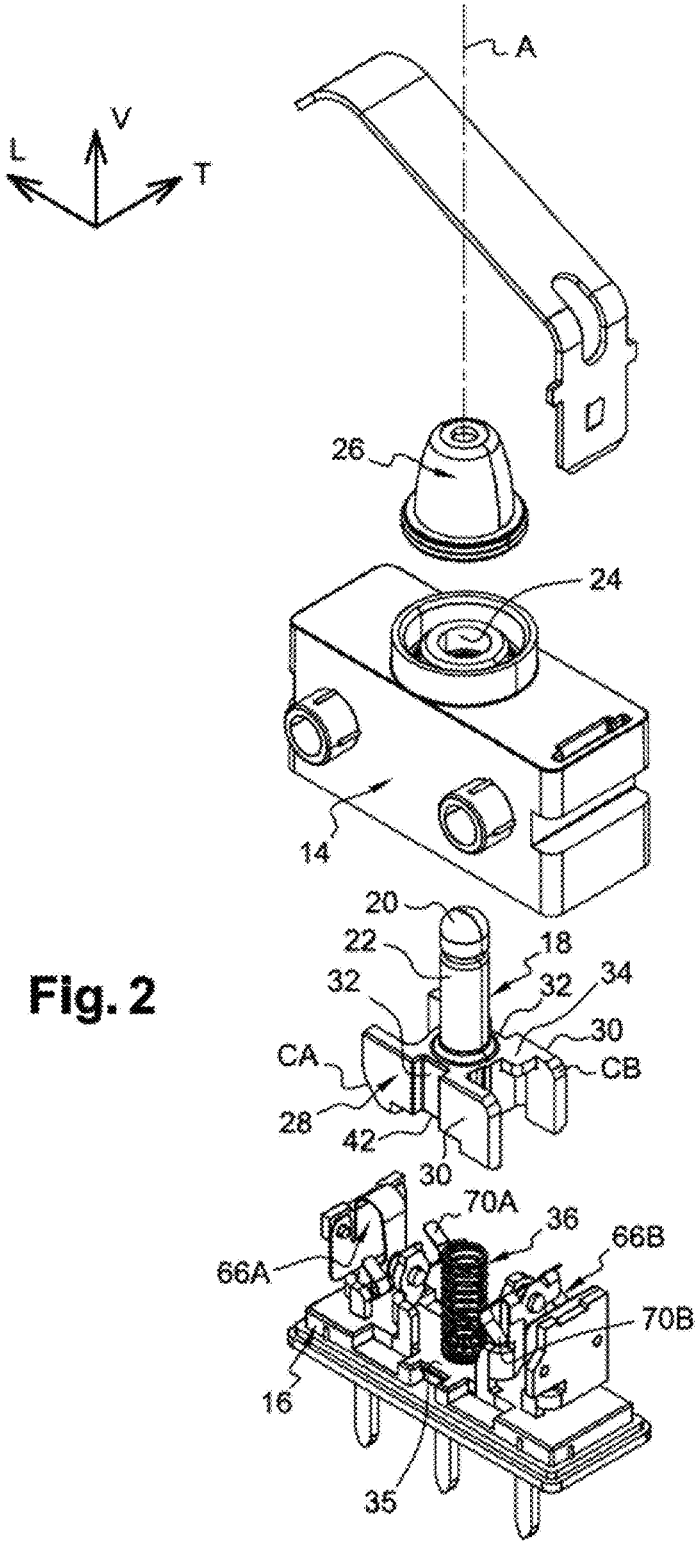
FIG. 2 is a perspective view similar to FIG. 1 showing some of the main components in an exploded manner.

FIGS. 1 and 2 show a switch 10 having a housing 12, of rectangular parallelepipedic shape and made of a housing upper cover part 14 and a housing lower part or base 16—defining a receiving portion—made of moulded or otherwise formed plastics or other materials, and which might be ultrasonic welded after mounting and assembly.

The switch 10 comprises a vertically extending and displaceable pushbutton 18 having a free upper end 20 for receiving an actuation force, here from an elastically deformable lever 21.

The main vertical upper stem 22 of the pushbutton 18 extends through a hole 24 of the housing upper cover part 14 in combination with a sealing boot 26.

The actuation member in the form of the pushbutton 18 is shown, by way of example in a non-limiting manner, as a plastic moulded part comprising a lower actuating portion 28 which is an extension of the main vertical stem 22 and which is arranged and extends inside the housing 12.

The lower actuating portion 28 comprises a pair of vertically and longitudinally extending guiding wings 30 each of which comprises a guiding vertical groove 32. In each guiding vertical groove is received an associated mating and complementary vertical rib 33 which is arranged in the upper cover part 14 of the housing 12 (see FIG. 3).

The push button is thus guided vertically with respect to the housing 12 along a vertical actuation axis A.

Figure 6:
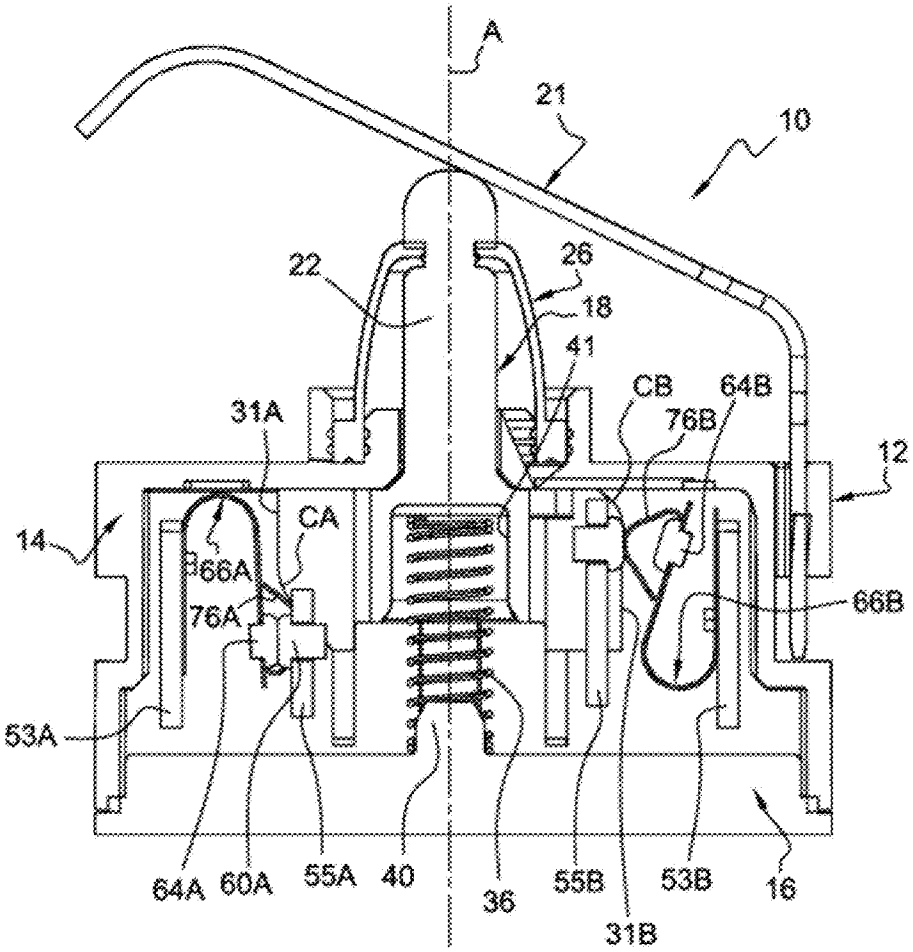
FIG. 6 is a cross-sectional view taken along line 6-6 of FIG. 3 showing the components in their upper position.

The switch 10 comprises a return spring 36 disposed vertically between the lower base 16 of the housing 12 and the actuating portion 28 of the pushbutton 18. The return spring 36 is a vertically and helicoidally wound spring which is received on a centering pin 40 (see FIG. 4) of the lower base 16 and having its upper end received in a pit 41 (see FIG. 6) formed in the lower horizontal face 42 of the actuating portion 28.

The return spring 36 is mounted so as to be vertically compressed in such a way that, when the external force applied downwardly to the free upper end 20 of the pushbutton is removed, the pushbutton is returned back to its upper rest position by the return spring 36.

This upper rest position is defined by the cooperation of an upper face 34 of the actuating portion 28 with a lower internal facing face of the upper cover part 14.

Starting from this upper position (and by compressing the return spring 36), the pushbutton 18 can be pushed downwardly towards its extreme lower position which is defined by the cooperation of the lower face 42 of the actuating portion 28 together with a facing portion 35 of the lower base part 16.

The pushbutton 18 is longitudinally arranged centrally in the housing 10.

The switch 10 comprises a conductive unit made of several conductive fixed elements belonging to metallic fixed conductive pins made of a cut metal sheet.

The conductive unit comprises a set of conductive fixed pins, each one comprising a fixed upper portion, arranged inside the housing 12, in the form of a vertical and transversal fixed conductive plate.

Figure 4:
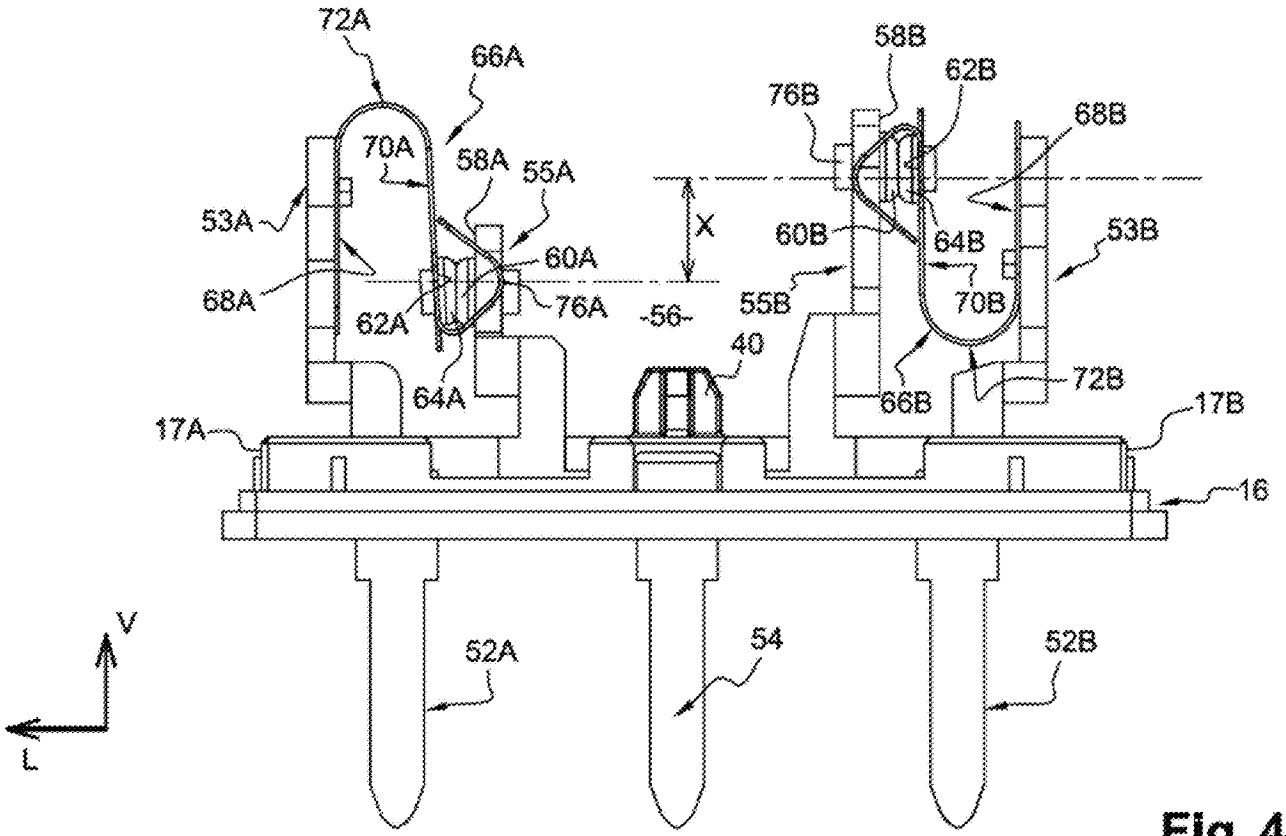
FIG. 4 is a lateral of the lower base receiving part of the housing together with all the components and elements supported by this part.

In an embodiment, referring to FIG. 4, the conductive unit comprises a first fixed pin 52A that extends through the base 16 and that comprises a first fixed plate 53A arranged close to a first longitudinal end 17A of the receiving portion of the base 16. The conductive unit also comprises a second fixed pin 52B that extends through the base 16 and that comprises a second fixed plate 53B arranged close to a second longitudinal end 17B of the receiving portion of the base 16.

In the illustrated example, the conductive unit comprises a third central "common" fixed pin 54 that extends through the base 16 and that comprises two central and parallel fixed plates 55A and 55B.

The transversal first fixed plate 53A and one of the central fixed plates 55A are facing each other, as well as the second fixed plate 53B and the other of the central fixed plates 55B.

Between the two central fixed plates 55A and 55B is defined a central space 56 for receiving the central core of the actuating portion 28 of the pushbutton 18.

As it can be seen from FIG. 3, the two central fixed plates 55A and 55B are received transversely between the two opposed guiding wings 30.

As shown in FIG. 4, each central fixed plate 55A, 55B defines a transversal and vertical fixed contact face 58A, 58B oriented outwardly and facing the associated fixed plate 53A, 53B associated with an outer fixed pin.

In the illustrated example of FIG. 4, for accommodating medium or high current, each fixed contact face 58A, 58B is equipped with a contact pill 60A, 60B. Each contact pill 64A is a conductive element that extends outward from its fixed contact face for making electrical contact with another contact element. Optionally, the contact pill may have a resistance that is higher than that of its associated contact element to support establishment and interruption of the switching way when using relatively high currents. The contact pills may be rounded, square, rectangular, ridged or formed or of other shapes, and they can be connected to fixed contact faces in any way, including by a weld, by a press fit, or by another type of mechanical connection.

Each fixed contact face 58A, 58B and its associated with a contact pill 60A, 60B together constitutes a fixed contact element, i.e. a first fixed contact element made of elements 58A and 60A and a second fixed contact element made of elements 58B and 60B.

According to various embodiments, each fixed contact element is associated with a first movable contact element and a second movable contact element respectively.

Figure 5:
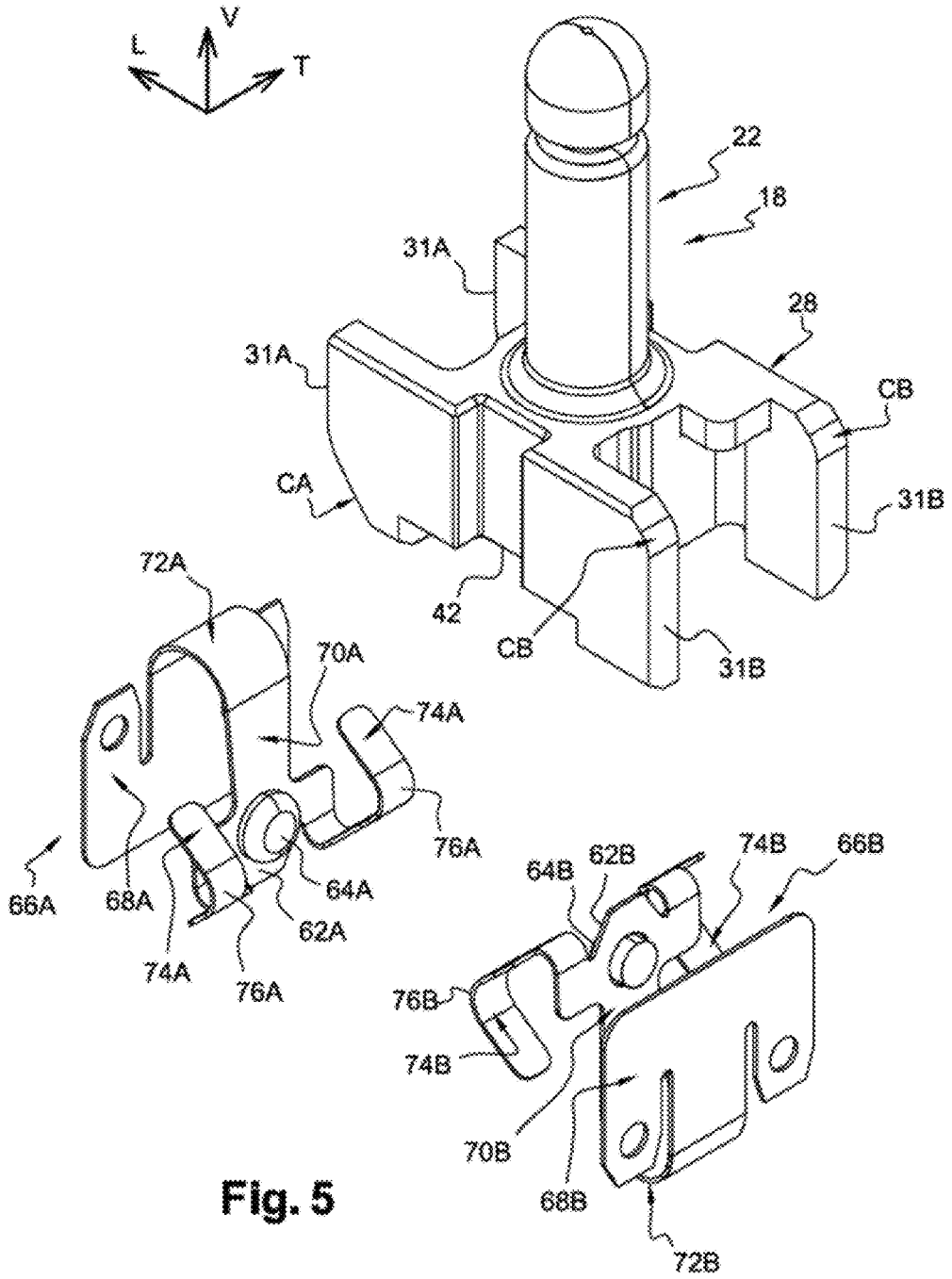
FIG. 5 is an enlarged perspective exploded view of the deformable blades in association with the pushbutton.

As illustrated in FIG. 5, the first movable contact element includes a movable contact face 62A of a first elastically deformable conductive blade 66A connected to a fixed branch 68A that (as shown in FIG. 4) is supported by a transversal fixed plate 53A. In the illustrated example—for accommodating medium or high current—the first movable contact face 62A is equipped with a first contact pill 64A. The first contact pill 64A is a conductive element that extends outward from the movable contact face 62A or another portion of the deformable conductive blade 66A for making electrical contact, such as contact with a contact pill of the corresponding fixed contact element. The contact pill may be rounded, square, rectangular, ridged or formed or of other shapes, and it can be connected to the blade 66A in any way, including by a weld, by a press fit, or by another type of mechanical connection. In the embodiment shown, the first contact pill 64A is a metallic rivet that is pressed into the elastically deformable blade.

The second movable contact element is a movable contact face 62B of a second elastically deformable conductive blade 66B supported by the transversal fixed plate 53B and, in the illustrated example—for accommodating medium or high current—the first movable contact face 62B is equipped with a second contact pill 64B. The second contact pill 64B may include a metallic rivet that is pressed into the elastically deformable conductive blade 66B, or it may be otherwise formed as described above for the first contact pill.

The first movable contact element 62A-64A is arranged facing the first fixed contact element 58A-60A and may come into contact with the first fixed contact element 58A-60A for establishing a first conductive switching way, as illustrated at FIG. 4.

The second movable contact element 62B-64B is arranged facing the second fixed contact element 58B-60B and may come into contact with the second fixed contact element for establishing a second conductive switching way as, illustrated at FIG. 4.

The lower base 16 of the housing 12 is positioned, and optionally formed as a plastic piece over-moulded on, the fixed pins 52A, 52B and 54. Each pin may be configured in the form of a tail extending vertically outwardly for the electrical connection of the switch 10, and for instance on the upper face of a non-illustrated printed circuit board. Alternatively, the pins can be fixed in the base 16 by means of force insertion or pressed fitting.

Each deformable contact blade 66A, 66B is the form of a cut and bent sheet of conductive metal optionally having, in cross section, a general shape of a hairpin.

Each deformable contact blade 66A, 66B comprises two vertically oriented and globally parallel branches among which a fixed branch 68A, 68B and an active branch 70A, 70B, both being connected by a 180° bent portion 72A, 72B extending between the adjacent ends of the two branches 68A-70A and 68B-70B.

Each vertical fixed branch 68A, 68B may be fixed by crimping on or otherwise connected to the associated fixed plate 53A, 53B.

Each vertically extending active branch 70A, 70B comprises a free end portion that is part of or connected to a corresponding movable contact face 62A, 62B.

Each free end portion is surrounded from both sides by a pair of parallel and opposed cam follower arms 74A, 74B (see FIGS. 4 and 5). Each cam follower arm in each pair 74A, 74B has a general horizontally oriented (convex arced or V shape) portion having its convexity summit 76A, 76B longitudinally oriented towards the actuating portion 28.

Each cam follower arm 74A, 74B extends in a vertical and longitudinal plane which is common to the plane of an associated wing 30.

In a "free" state and as illustrated at FIG. 4, i.e. when they are not elastically deformed by the actuating portion 28, the design of each deformable blade 66A, 66B is such that the pair of facing movable contact elements 58A-62A and 58B-62B are in mutual contact, here by means of the contact pills 60A-62A and 60B-62B.

In such a "theoretical" position, both the first conductive switching way (between pins 52A and 54) and the second conductive switching way (between pins 52B and 54) are established.

In the illustrated embodiment, the first bent portion 72A is an upper portion of the hairpin shaped first deformable blade 66A, and the second bent portion 72B is a lower portion of the hairpin shaped second deformable blade 66B.

Consequently, the summits 76A of the first cam follower arm pair are vertically and downwardly offset (see offset "X" at FIG. 4) with respect to the summits 76B of the second cam follower arm pair.

As will be explained below, each blade 66A, 66B is deformable, under longitudinal and/or horizontal pressure acting on the cam follower arms' summits 76A, 76B.

For acting on the first deformable blade 66A and determining the status (established or interrupted) of the first and second conductive switching ways, the actuating portion 28 comprises a first cam CA which co-operates with the cam follower arms 74A of the first deformable blade 66A to deform or relax the first deformable blade 66A for horizontally and longitudinally moving the first movable contact element 62A-64A to come into contact, or out of contact, with the portion of the first fixed contact element 58A-60A, depending on the vertical position of the pushbutton.

The actuating portion 28 also comprises a second cam CB which co-operates with the cam follower arms 74B of the second deformable blade 66B to deform or relax the second deformable blade 66B for horizontally and longitudinally moving the second movable contact element 62B-64B to come into contact, or out of contact, with the portion of the second fixed contact element 58B-60B, depending on the vertical position of the pushbutton.

Referring collectively to FIGS. 1, 3 and 5, each wing 30 of the actuating portion 28 is delimited longitudinally by transversal and vertical actuating faces 31A, 31B.

The first cam CA is arranged at the lower end of the actuating faces 31A, and the second cam CB is arranged at the upper end of the actuating faces 31B.

In the illustrated embodiment, in the upper rest position of the pushbutton and of the actuating portion 28, the switch is of the normally closed type concerning the first switching way because the summits 76A are located vertically under the first cam CA and the blade 66A is in the state illustrated at FIG. 4.

In this same upper rest position, the switch is of the normally open type concerning the second conductive way because the summits 76B are vertically facing and bearing against portions of the vertical actuating faces 31B, and the blade 66B is deformed with respect to the state illustrated at FIG. 4.

Figures 8A, 8B, 8C:
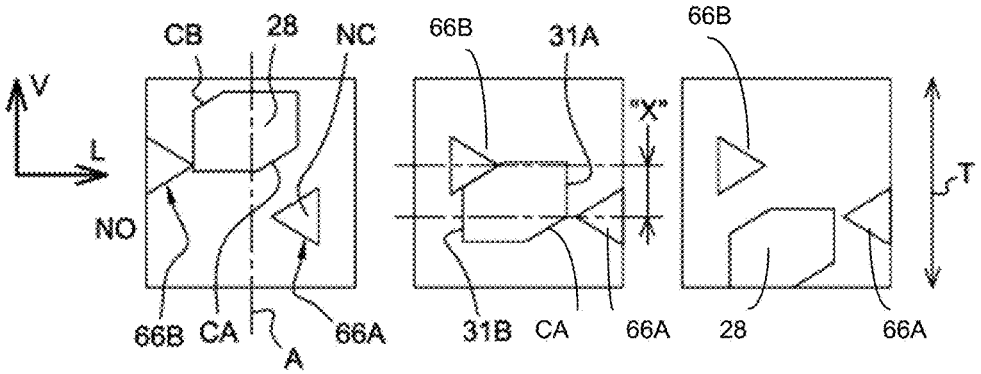
FIGS. 8A, 8B and 8C are schemes illustrating the functioning of the switch according to the first embodiment.

This state is schematically illustrated at FIG. 8A. FIG. 8A illustrates the normally open position of the switch, in which deformable blade 66B and deformable blade 66A is in the open position that is normally open is in its open position. When applying a vertical and downward force on the pushbutton, the actuating portion 28 is displaced with respect to the deformable blades 66A and 66B first along a pre-travel until the summits of each blade (shown as the innermost peaks of each blade) reach the beginning of the cams CA and CB.

Thus the switching position illustrated at FIG. 8B is reached where the first switching way has been interrupted and where the second switching way has been established. In FIG. 8B, actuating face 31A of the actuating portion has passed the summit of blade 66A and pushes blade 66A to the open position, allowing the second movable and fixed contact elements to close their circuit. Simultaneously, the normally closed cam CA has reached the summit of blade 66A, allowing the first movable and fixed contact elements to open their circuit. The offset dimension "X" in FIG. 8A also corresponds to that shown in FIG. 5. The offset dimension X is such that the contact timing is simultaneous.

The design of the switch is such that it permits an over-travel such as illustrated at FIG. 8C without modifying the status of the switching ways established at FIG. 8B. The total travel is illustrated by the vertical arrow "T".

Thus, a travel of the actuating portion 28 from its upper position towards its lower position provokes a change of state of the first and of the second switching ways.

When the user releases its actuation effort on the stem 22, the previously compressed return spring 36 acts upwardly on the pushbutton 18 to push it vertically and upwardly.

The design according to the invention using a "caming" (i.e., with the use of cams) actuating portion enables over-travel of actuation;

Costs may be reduced thanks to design of the various fixed and movable contact elements all fixed to and supported by the base 16, and to the concept of the actuator which is a plastic moulded part.

Durability problems may be solved thanks to the fact that there are no longer any sliding contacts.

The general concept described above permits any arrangement of the establishment and interruption of conductive ways, in position and in number.

Figure 7:
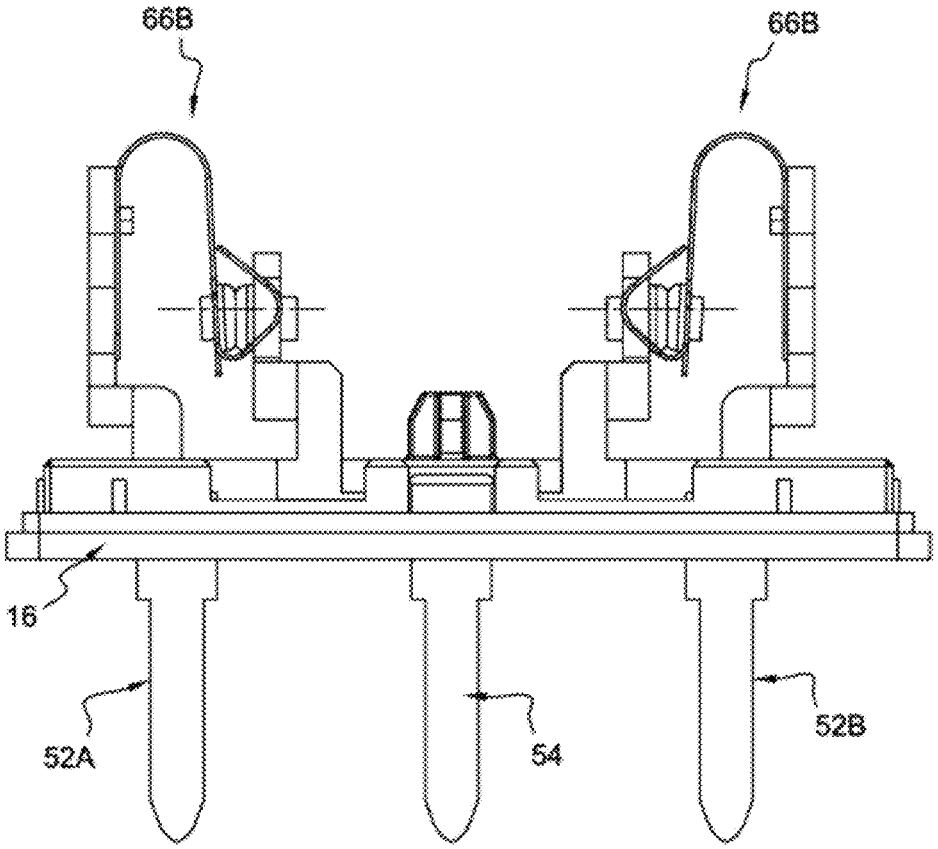
FIG. 7 is a view analogous to the view of FIG. 4 showing a second embodiment of the switch having two identical deformable blades.
Figures 9A, 9B, 9C:
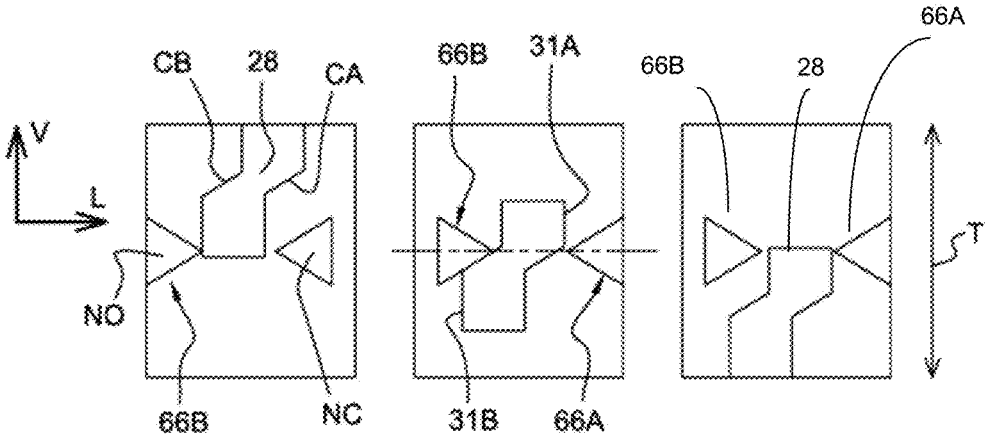
FIGS. 9A, 9*b* and 9C are schemes analogous to those of FIGS. 8A, 8B and 8C illustrating the functioning of the switch according to the second embodiment.

According to the other embodiment illustrated at FIG. 7 and to FIGS. 9A to 9C, the two deformable blades 66A and 66B are identical with here an upper bent portion. Thus, the summits of the blades are vertically aligned, but the total travel "T" of the actuating element 28 is greater than in the previous embodiment. According another not illustrated variant, the two deformable blades can be identical having both a lower bent portion.

In some embodiments, a switch such as that shown above may comprise only one switching way having either a lower or an upper bent portion.

For low current, the contact pills might be omitted.

The features and functions disclosed above, as well as alternatives, may be combined into many other different systems or applications. Various presently unforeseen or unanticipated alternatives, modifications, variations or improvements may be made by those skilled in the art, each of which is also intended to be encompassed by the disclosed embodiments.

The invention claimed is:

1. An electrical switch comprising:

a housing having a receiving portion;

an actuation member in a form of a pushbutton comprising:

a stem extending out of the housing, and an actuating portion extending in the housing, the pushbutton being configured so that when an external force is applied to the pushbutton, the pushbutton will move vertically relative to the housing between a pushbutton upper position and a pushbutton lower position;

a first pair of associated contact elements comprising:

a first fixed contact element comprising a first fixed contact face, and a first movable contact element arranged facing the first fixed contact element and that may come into contact with the first fixed contact element for establishing a first conductive switching way between the first movable contact element and the first fixed contact element, wherein:

the first movable contact element comprises a first elastically deformable conductive blade supported by the receiving portion; and the first elastically deformable conductive blade comprises a fixed branch and an active branch;

a second pair of associated contact elements comprising:

a second fixed contact element comprising a second fixed contact face; and a second movable contact element arranged facing the second fixed contact element and that may come into contact with the second fixed contact element for establishing a second conductive switching way between the second movable contact element and the second fixed contact element, wherein:

the second movable contact element comprises a second elastically deformable conductive blade supported by the receiving portion, and the second elastically deformable conductive blade comprises a fixed branch and an active branch, wherein:

the actuating portion of the actuation member comprises a first cam which is configured to cooperate with a first cam follower portion of the active branch of the first elastically deformable conductive blade to deform or relax the active branch of the first elastically deformable conductive blade for longitudinally moving the first movable contact element to come into contact, or out of contact, with the first fixed contact element; and the actuating portion of the actuation member further comprises a second cam which is configured to cooperate with a second cam follower portion of the active branch of the second elastically deformable conductive blade to deform or relax the active branch of the second elastically deformable conductive blade for longitudinally moving the second movable contact element to come into contact, or out of contact, with the second fixed contact element.

2. The electrical switch according to claim 1, wherein the first movable contact element comprises a free end portion of the active branch of the first elastically deformable conductive blade.

3. The electrical switch according to claim 1, wherein the first elastically deformable conductive blade is in a form of a hairpin so that the fixed branch of the first elastically deformable conductive blade extends vertically upward, and the active branch of the first elastically deformable conductive blade extends vertically downward from an upper end of the fixed branch of the first elastically deformable conductive blade.

4. The electrical switch according to claim 1, wherein the first movable contact element comprises a portion of the active branch of the first elastically deformable conductive blade arranged at a free end of the active branch of the first elastically deformable conductive blade and facing the first fixed contact element.

5. The electrical switch according to claim 1, wherein when the first cam cooperates with the first cam follower portion, an associated movable portion of the first elastically deformable conductive blade is maintained in contact under pressure with the first fixed contact element.

6. The electrical switch according to claim 1, wherein one or more of the first movable contact element and the first fixed contact element are provided with a contact pill.

7. The electrical switch according to claim 1, wherein the actuating portion is configured so that when the actuating portion is in an upper active position, one of the first and second conductive switching ways is established and the other conductive switching way is interrupted, and when the actuating portion is in a lower active position, the one conductive switching way is interrupted and the other conductive switching way is established.

8. The electrical switch according to claim 1, wherein the first and second cam follower portions are arranged longitudinally face-to-face, and further wherein the actuating portion of the actuation member is arranged longitudinally between the first and second movable contact elements.

9. The electrical switch according to claim 1, wherein the second elastically deformable conductive blade is in a form of a hairpin so that the fixed branch of the second elastically deformable conductive blade extends vertically downward, and the active branch of the second elastically deformable conductive blade extends vertically upward from a lower end of the fixed branch of the second elastically deformable conductive blade.

10. The electrical switch according to claim 1, wherein the second movable contact element comprises a portion of the active branch of the second elastically deformable conductive blade arranged at a free end of the active branch of the second elastically deformable conductive blade and facing the second fixed second contact element.

11. The electrical switch according to claim 1, wherein when the second cam cooperates with the second cam follower portion, an associated movable portion of the second elastically deformable conductive blade is maintained into contact under pressure with the second fixed contact element.

12. The electrical switch according to claim 1, wherein one or more of the second movable contact element and the second fixed contact element are provided with a contact pill.

13. The electrical switch according to claim 1, wherein the electrical switch includes a plane of symmetry, and components of the electrical switch are substantially symmetrically aligned on each side of the plane of symmetry.

14. An electrical switch comprising:

a housing having a receiving portion;

an actuation member in a form of a pushbutton comprising:

a stem extending from the housing, and an actuating portion extending in the housing, wherein the pushbutton is configured so that when an external force is applied to the pushbutton, the pushbutton moves vertically relative to the housing between a pushbutton upper position and a pushbutton lower position;

a first pair of associated contact elements comprising:

a first fixed contact element comprising a first fixed contact face, and a first movable contact element arranged facing the first fixed contact element so that when the pushbutton is moved to one of the upper position or the lower position, the first movable contact element comes into contact with the first fixed contact element and establishes a first conductive switching way between the first movable contact element and the first fixed contact element, wherein the first movable contact element comprises a first elastically deformable conductive blade, the first elastically deformable conductive blade having an active branch; and a second pair of associated contact elements comprising:

a second fixed contact element comprising a second fixed contact face, and a second movable contact element arranged facing the second fixed contact element so that when the pushbutton is moved to the other of the upper position or the lower position, the second movable contact element comes into contact with the second fixed contact element and establishes a second conductive switching way between the second movable contact element and the second fixed contact element, wherein the second movable contact element comprises a second elastically deformable conductive blade supported by the receiving portion, the second elastically deformable conductive blade having an active branch, wherein the actuating portion of the actuation member comprises a first cam configured to cooperate with a first cam follower portion of the active branch of the first elastically deformable conductive blade to deform or relax the active branch of the first elastically deformable conductive blade for longitudinally moving the first movable contact element to come into contact, or out of contact, with the first fixed contact element, and wherein the actuating portion of the actuation member further comprises a second cam configured to cooperate with a second cam follower portion of the active branch of the second elastically deformable conductive blade to deform or relax the active branch of the second elastically deformable conductive blade for longitudinally moving the second movable contact element to come into contact, or out of contact, with the second fixed contact element.

15. The electrical switch according to claim 14, wherein the first cam is provided on a first actuating face of the actuation member, and the second cam is provided on a second actuating face of the actuation member.

16. The electrical switch according to claim 14, wherein the first cam is configured to move the first movable contact element into contact with the first fixed contact element when the actuation member is in a first vertical position, and further wherein the second cam is configured to move the second movable contact element into contact with the second contact element when the actuation member is in a second vertical position.

17. The electrical switch according to claim 14, wherein:

the first elastically deformable conductive blade is in a form of a hairpin and further comprises a fixed branch that extends vertically upward, and the active branch of the first blade extends vertically downward from an upper end of the fixed branch of the first elastically deformable conductive blade; and the second elastically deformable conductive blade is in a form of a hairpin and further comprises a fixed branch that extends vertically downward, and the active branch of the second blade extends vertically upward from a lower end of the fixed branch of the second elastically deformable conductive blade.

* * * * *